US005527597A

United States Patent [19]

Stanhope et al.

[11] Patent Number: 5,527,597

[45] Date of Patent: Jun. 18, 1996

[54] STRETCHABLE FLAME RESISTANT FABRIC

[75] Inventors: Michael T. Stanhope, Atlanta; Denise N. Statham, Sharpsburg, both of Ga.

[73] Assignee: Southern Mills, Inc., Union City, Ga.

[21] Appl. No.: 397,428

[22] Filed: Mar. 1, 1995

[51] Int. Cl.[6] ..... D03D 3/00

[52] U.S. Cl. ..... 428/231; 19/51; 139/426 R; 428/225; 428/229; 428/230; 428/257; 428/902

[58] Field of Search ..... 428/225, 229, 428/230, 231, 257, 258, 259, 902; 139/426 R; 19/18.5, 51

[56] References Cited

U.S. PATENT DOCUMENTS 5,069,957 12/1991 Vandermeersch ..... 428/230

*Primary Examiner*—James J. Bell

*Attorney, Agent, or Firm*—Hopkins & Thomas

[57] ABSTRACT

A stretchable flame resistant fabric (10) formed from a series of flame resistant warp yarns (11) interwoven with a series of filling yarns (12). The filling yarns (12) comprise core yarns (15) formed from an elastic material, wrapped with a series of wrap yarns (16) formed from a flame resistant material. The stretchable flame resistant fabric (10) thus provides a desired degree of flame resistance protection, while at the same time is stretchable in one direction to provide the fabric with greater flexibility without sacrificing flame resistance protection.

21 Claims, 2 Drawing Sheets

STRETCHABLE FLAME RESISTANT FABRIC

FIELD OF THE INVENTION

The present invention relates in general to flame resistant, stretchable insulated fabrics and garments made of such fabrics. In particular, the present invention relates to a flame resistant fabric that is formed from flame resistant yarns interwoven with stretchable yarns each formed with an elastic core that is spirally wrapped with a flame resistant yarn. The fabric can stretch in at least one direction so that garments made from the fabric have increased flexibility and provide greater freedom of movement substantially without sacrificing protection against exposure to extreme heat and fire.

BACKGROUND OF THE INVENTION

For firefighters, foundry workers and other workers whose occupations expose them to extreme heat and fire, safety is a paramount concern. Working in and around environments wherein one is exposed to extreme heat and fire continually subjects workers to risks of being seriously burned or overcome by heat exposure, which can cause heart attacks, strokes, dehydration and other injuries that very well can be fatal. Accordingly, it is a necessity that the clothing of such firefighters, foundry workers and similar personnel provide a high degree of heat and fire resistance protection to protect such workers against the hazards of their work environments.

In attempting to provide maximum protection against heat and fire for firefighters, etc., the emphasis in the prior art has been on using thermal and/or flame resistant fabrics to form protective garments such as firefighter's turnout coats, pants, etc. The flame resistant fabrics used for such garments typically are formed of woven inherently flame resistant yarns and are thick, heavy and stiff and are assembled in multiple layers to form the garments. The more layers of fabric used, the better the protection, but the weight and stiffness of the garment also correspondingly increases. Thus, the garments formed therefrom generally are heavy, bulky and somewhat inflexible.

The weight of flame resistant garments contributes to the stress to which the wearers are subjected, as the heavier the garment the more exertion that is required from the wearer to move and work in the garment. In general, therefore, the makers of prior art flame resistant garments have tried to strike a balance between providing as high a degree of flame resistance protection as possible while limiting the weight of such a garment so that a worker could be adequately mobile under his or her extremely stressful work conditions.

Further, while such conventional flame resistant fabrics generally have been adequate for protecting workers against exposure to fire and extreme heat, the stiffness and general inflexibility of such fabrics tends to cause another significant problem which is the restriction of freedom of movement of a worker while wearing garments made from such fabrics. By restricting the freedom of movement of the wearer, further stress is placed upon and greater exertion is required from the wearer in order to move and work in the protective garments. This increased exertion further increases the risks of the worker suffering heart attacks, strokes, heat exhaustion, etc.

Attempts have been made in the prior art to develop garments, for example firefighter's turnout coats, that protect against exposure to extreme heat and fire, but that are flexible so as to enable greater freedom of movement to the wearer. Such prior art garments, however, have been limited to use of conventional, heavy, somewhat inflexible flame resistant fabrics, with portions of the garments being formed with lighter, less flame and thermally resistant materials or formed as oversized pockets or bellows so as to make the garments more flexible. Such flexibility, however generally has been limited to the joints of the garments and not across the garments as a whole. For example, U.S. Pat. No. 4,922,552 discloses a firefighters' garment formed from layers of a thick, flame resistant fabric in which an outer layer of the protective flame resistant material has portions cut-away therefrom, and replaced with a layer of a lighter material having a significantly less degree of flame resistance and protective properties, but which has greater flexibility and less bulk. The problem with such a garment is that the flexibility of the garment is limited to specific portions of the garment and some flame resistance protection is sacrificed to achieve this enhanced flexibility. The cutaway portions of the garment generally are formed only in a few selected areas, specifically at the joints such as an elbow joint or underarm, rather than making the entire garment much more flexible. Additionally, a reduction of thermal or flame resistance properties at the selected areas leaves those areas more vulnerable to fire and extreme heat.

Alternatively, U.S. Pat. No. 5,031,242 shows a firefighter's turnout coat and pants wherein the elbow joints and knee joints are formed to include expandable pockets or bellows to enable the joints to flex and move. These bellows, however, are formed by cutting the sleeves and pant legs and then applying elliptical patches in the areas of the cuts in the pants and legs. Thermal and flame resistance protection is not sacrificed, but only limited flexibility, and thus only limited freedom of movement, can be achieved.

Accordingly it can be seen that a need exists for stretchable, lighter weight flame resistant fabrics and garments made from the fabrics, such as firefighters' turnout coats and pants, etc. that provide optimal thermal and flame resistance protection and that have an inherent stretchability and flexibility to provide greater flexibility to the garments and greater mobility and durability to the wearer of the garment without sacrificing the thermal or flame resistance capabilities of the garment.

SUMMARY OF THE INVENTION

Briefly described, the present invention comprises a stretchable flame resistant fabric and garments made therefrom, so that the garments have thermal and flame resistance capabilities and also have an inherent stretch-ability and flexibility. The fabric is formed from a series of warp yarns interwoven with a series of stretchable weft or filling yarns. The warp yarns are formed of a flame and/or thermal resistant material, typically a blend of KEVLAR®, or similar aromatic polyamide fiber, and poly-benzimidazole (PBI). For example, a KEVLAR®/PBI blend in a ratio of approximately 60% KEVLAR® to approximately 40% PBI has been found to provide heat and fire resistance properties in compliance with National Fire Protection Association safety standards for firefighter's bunker gear. The warp yarns also can be formed from other types of flame resistant materials which, when woven into fabrics, comply with current national fire protection safety standards.

The weft or filling yarns each comprise a stretchable core yarn spirally wrapped or overspun with a series of wrap yarns or fibers. The core yarns are formed from elastic materials such as spandex or rubber so as to enable the filling yarns to stretch along their lengths. The wrap threads spun about the core yarns generally are formed from the same flame and/or heat resistant material as the warp yarns, i.e. a KEVLAR®/PBI or similar flame resistant material and protect the elastic core yarns from degradation or melting, when exposed to extreme temperatures and fire.

The wrap yarns/fibers are wrapped tightly about the core yarns, with the tightness of the wrapping being dependent upon the size of the core yarn, so as to leave substantially no space between the adjacent segments of the warp yarns, so as to shield the core yarn from exposure to the exterior atmosphere. Typically, multiple plies/layers of wrap yarns/fibers are spun about the core yarn although a single wrap yarn can be spun about each core yarn if so desired. The wrapping of the wrap yarns about the core yarns forms a protective sheath or covering about the core yarns, to protect the core yarns from fire and extreme heat. The core yarns are further protected by the interweaving of the filling yarns with the flame resistant warp yarns. The tightness of the wrapping of the wrap yarns about the core yarns and the weaving of the warp yarns ensures that the core yarns remain substantially protected from direct exposure to heat as the core yarns are stretched along their lengths, as the wrap yarns tend to straighten slightly but maintain coverage about the core yarns as the core yarns are stretched. Further, even if the core yarns are exposed to and degraded by heat and fire, the thermal/flame resistance protection of the garment is not compromised due to the interweaving of the warp yarns with the filling yarns.

After the warp and filling yarns have been woven together to form the fabric, the fabric is subjected to a finishing operation, during which a water repellent finish is applied to the fabric and the fabric is heatset. Thereafter, oven testing is conducted on a sample of the fabric in accordance with the national standards for flame resistant protective garments. The stretchable flame resistant fabric thus formed exhibits high thermal/flame resistance characteristics while at the same time remains stretchable across its weft or filling direction. It also is possible for the warp yarns to comprise elastic core yarns wrapped with flame resistant wrap fibers so that the resultant fabric can be stretchable along its warp direction, instead of or in addition to being stretchable across its filling direction. Garments made from this fabric accordingly are provided safely with enhanced flexibility and stretchability so as to give the wearer increased freedom of movement without sacrificing the flame resistant protective capabilities of the garment.

It is therefore an object of the present invention to provide a stretchable fabric having flame resistant capabilities.

Another object of the present invention is to provide a flame resistant fabric having a series of elastic core yarns wrapped with flame resistant fibers that protect the elastic core yarns from exposure to heat and fire so that the resultant fabric provides a desired level of flame/thermal resistance protection and is stretchable in at least one direction without risking a loss of such flame resistance protection.

Another object of the present invention is to provide a stretchable fabric having flame resistant capabilities for forming safe flame resistant, protective garments having enhanced flexibility without a reduction in flame resistance protection.

Another object of the present invention is to provide a flexible flame resistant garment formed of a fabric that maintains its integrity and flame resistance protection even if the flexibility of the garment becomes diminished by exposure to heat and fire.

Still another object of the present invention is to provide a stretchable flame resistant garment such as a firefighter's turn-out coat that provides enhanced flame resistance protection in accordance with National Fire Protection Association Safety Standards for the protective garments and which has increased flexibility over conventional thermal/flame resistant protective garments.

Other objects, features and advantages of the present invention will be come apparent to those skilled in the art upon a review of the following specification, when taken in conjunction with the accompanying drawings.

DETAILED DESCRIPTION

Figure 1:
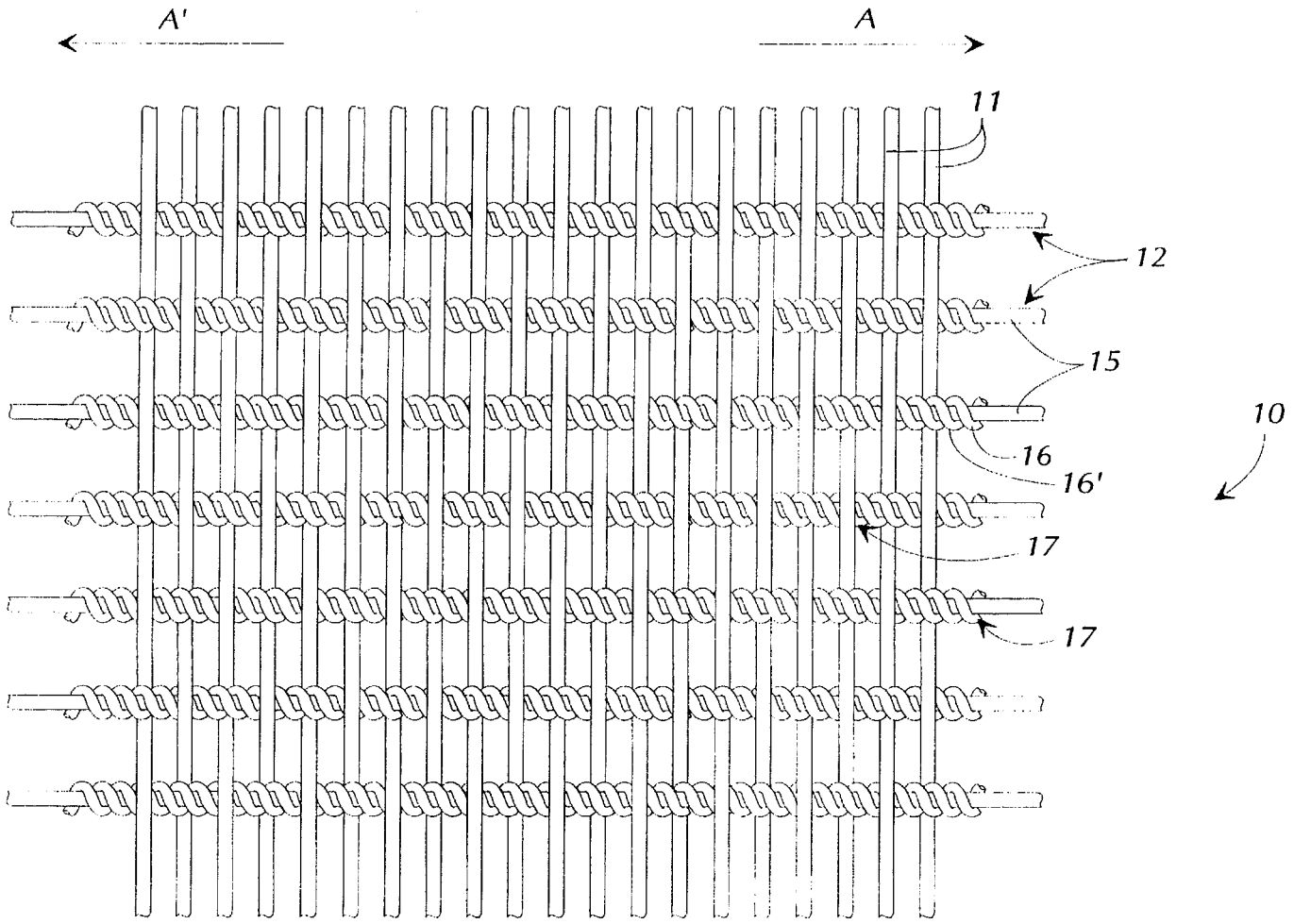
FIG. 1 is an enlarged top plan view of a portion of the thermally resistant fabric.

Referring now in greater detail to the drawings in which like numerals indicate like parts throughout the several views, FIG. 1 illustrates a stretchable flame resistant fabric 10 comprising a series of longitudinally extending warp yarns or fibers 11 and a series of laterally extending weft or filling yarns or fibers 12. The warp yarns generally are of a size between 8 to 11 cotton count, where "cotton count" is the number of hanks of yarn per pound of yarn, although other size warp yarns can be used as desired. The size of the warp yarns is dependent on providing a desired high level of thermal and flame resistance protection while ensuring that the finished fabric is of garment quality. Further, the warp yarns can be formed from multiple plies, i.e., 16/2 to 22/2 count yarns can be used.

The warp yarns are formed from a flame resistant material such as a blend of KEVLAR® or similar aromatic polyamide fiber, and polybenzimidazole (PBI). For example, the warp yarns can comprise a blend of approximately 60% KEVLAR® to approximately 40% PBI, which blend has been found to provide a desired level of flame resistance protection in compliance with National Fire Protection Association (NFPA) §1971, 1991 Edition, Standards. However, it also will be understood by those skilled in the art that various other types of flame resistant materials also can be used for the warp yarns in place of a KEVLAR®/PBI blend. Such additional flame resistant fibrous materials could include: aramids, polynosic rayon, flame resistant cellulosics such as flame resistant cotton or acetate, flame resistant polyester, polyvinyl alcohol, polytetrafluoroethylene, flame resistant wool, polyvinyl chloride, polyetheretherketone, polyetherimide, polyethersulfone, polychlal, polyimide, polyamide, polyimideamide, polyolefin, polybenzoxazole, carbon, modacrylic acrylic, melamine, glass, or any other flame resistant materials that can be used for the manufacture of fabrics for garments. The warp yarns also provide strength to the fabric along the warp direction thereof and resistance to tearing.

Figure 2A:
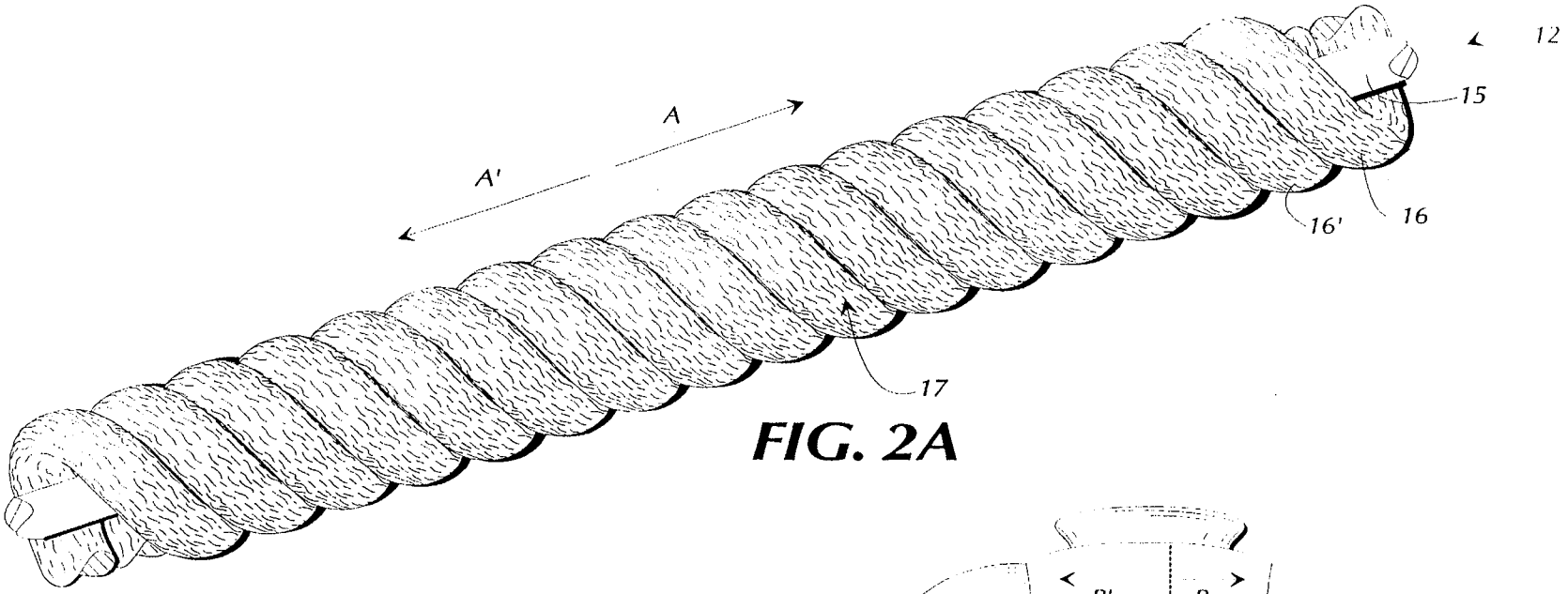
FIG. 2A is a side elevational view illustrating an elastic core yarn wrapped with multiple wrap yarns/fibers.

As shown in FIG. 1, the warp yarns are interwoven with a series of laterally extending weft or filling yarns or fibers 12, which extend across the weft direction of the fabric, forming a lattice structure. The filling yarns 12 are composite, core-spun yarns, as shown in FIG. 2A, each formed from a core yarn 15 with a series of wrap yarns 16 and 16' wound or twisted thereabout. The core yarns in general are formed from an elastic material such as rubber, or spandex or similar elastic materials that have an inherent stretchability or elasticity. The size of the core yarns is a matter of choice based upon factors of the amount of stretchability and the quality of the finished fabric for forming a garment. Generally, the core yarns will be in a range of 40 to 70 denier, which translates to approximately 6 to 14% of the weight of the filling yarns being spandex or other elastic material.

As FIG. 2A illustrates, the core yarns 15 are helically wrapped with heat resistant wrap yarns/fibers 16, 16'. The wrap yarns generally are formed from the same flame resistant material as the warp yarns, i.e. a KEVLAR®/PBI blend or other flame resistant material, and provide flame resistance protection to the elastic core yarn. Typically, the wrap yarns will range in size from 16/2 to 22/2 cotton count, meaning that two single plies of a 16 to 22 cotton count yarn are wound together, creating a composite yarn of 8 to 11 cotton count in size. It will be understood, however, that as with the warp yarns, other size wrap yarns also can be used if desired, with the size of the yarns being limited by the quality of the finished fabric, which, while designed to be durable and tough, still must be of garment quality.

Figure 2B:
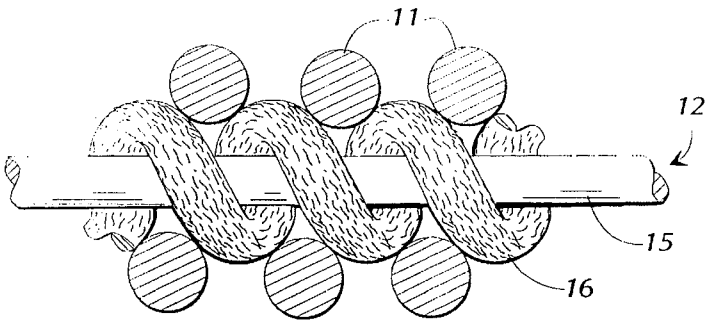
FIG. 2B is a side elevational view illustrating an elastic core yarn wrapped with a single wrap yarn/fiber and showing the position of the warp yarns woven about the filling yarns.

The wrap yarns/fibers are wrapped tightly about the core yarn at approximately 9 to 11 turns per inch. It also is possible for the wrap yarns to be wrapped about the core yarns in fewer or greater turns per inch as desired as long as the wrap yarn covers the core yarn to prevent exposure of the core yarns to heat and flame. The number of wraps is dependent on the size of the wrap yarns as the larger the wrap yarns, the fewer wraps or twists per inch are needed to ensure complete coverage. The number of turns per inch further is dictated by the desired characteristics of the finished fabric, such as softness, liveliness, stiffness, etc. It also will be understood by those skilled in the art that while a pair of wrap yarns 16 and 16' are shown wound about the core yarn 15 in FIG. 2A, it is possible to use a single wrap yarn 16, as shown in FIG. 2B, typically of a larger size and wrapped with a greater number of turns per inch, or a greater number of plies of wrap yarns as desired to provide substantially complete coverage and thus substantially completely flame resistant protection to the core yarns.

The wrapping of the heat resistant yarns 16, 16' about the core yarn 15 forms a protective sheath or covering 17 about the elastic core yarns. Since the core yarns have a lower resistance to heat and fire than the wrap yarns and tend to degrade or melt from exposure to extreme temperatures and fire, the wrap yarns protect the elastic core yarns from direct exposure to heat and fire that would otherwise cause the core yarns to degrade or melt. As a result of the close winding or wrapping of the wrap yarns, when the core yarns are stretched along their lengths, the wrap yarns tend to slightly straighten, but the wrap yarns still maintain substantially complete coverage about the core yarns. The shielding of the core yarns further is enhanced by the interweaving of the filling yarns with the warp yarns 11 (FIGS. 1 and 2B). Thus, the core yarns generally are not exposed directly to extreme temperatures, heat and fire. Rather, the core yarns remain substantially protected or heat shielded by the wrap and warp yarns, even when the stretchable flame resistant fabric is stretched or pulled in the weft direction as indicated by arrows A and A' (FIGS. 1 and 2A).

Even if the core yarns are exposed to heat and fire, such exposure typically will be limited to isolated points along the length of the core yarns. Thus, while the stretchability of the filling yarns could be reduced by breaks in the core yarns at isolated points, elasticity of the fabric across the filling direction overall will be maintained. Further, even if the core yarns become substantially completely degraded, eliminating the stretchability of the fabric, the fabric still will retain flame resistance protection due to the interweaving of the warp yarns and the wrap yarns of the filling yarns. Thus, the weave between the warp and filling yarns is not broken even if the elastic core yarns are destroyed.

After the warp yarns and filling yarns have been interwoven to form the stretchable flame resistant fabric, the stretchable heat resistant fabric is subjected to a finishing application. During finishing, the fabric is jet scoured in rope form by applying a detergent and water bath to the fabric. The detergent bath is applied under pressure and is heated to temperatures typically in excess of approximately 200° F. The high temperature of the bath heats the fabric and activates the elastic core yarns, causing the elastic core yarns to draw up or shorten, in turn causing the fabric to shrink across its width. The amount of shrinkage of the fabric is dependent on the strength and size of the core yarns, although typically the fabric can shrink up to half its width. As a further result, as the fabric shrinks, it becomes denser and the wraps of the wrap yarns about the core yarns are pulled closer together, further covering and shielding the core yarns.

After scouring, a finish is applied to the fabric. In the preferred embodiment, the finish is a moisture repellant that complies with National Fire Protection Association (NFPA) § 1971, 1991 Edition, requirements for firefighter's bunker gear and tends to repel water, oil and other liquid materials and prevents such liquids from soaking into and through the fabric. It is possible, however, to use other types of finishes or materials, including hydrophilic or other types of materials, instead of a moisture repellant if so desired. The shrunk fabric is put on a tenter frame that holds the fabric taut as the fabric is heated to relax the fabric, and the fabric is stretched to a desired width. The width to which the fabric is stretched limits the amount of elasticity and recovery of the finished fabric. For example, if the fabric is stretched to its full width, the elasticity of the fabric will be substantially eliminated, but if the fabric is not stretched, it will be too narrow for practical use but will have a high amount of stretchability. The fabric usually is stretched to a desired width, typically 50–70 inches in width, for a desired amount of stretch. The stretched fabric is heatset to cure the moisture repellant finish and to fix the width of the fabric and therefore the amount of stretchability of the fabric.

Additionally, if desired, the fabric can be dyed to give the fabric a desired hue or tint. The dyeing of the fabric generally is done following the scouring of the fabric and prior to the application of the finish.

Once the fabric is finished, the fabric is subjected to testing to certify the resultant stretchable flame resistant fabric to NFPA § 1971, 1991 edition, requirements for protective bunker gear for firefighters. Among other requirements, NFPA § 1971 mandates that no textile component of a turn-out or bunker gear garment (i.e., firefighters' turn-out coat) melt, drip, separate, or ignite upon static exposure in a 500° F. oven for at least five minutes, and that the fabric not shrink more than 10 percent in the warp or filling direction upon such exposure. To test the fabric, a sample of the fabric is taken from each production run of the fabric and is placed in an oven where the sample is subjected to temperatures of over 500° F. for at least five minutes to ensure that each production run of the fabric complies with NFPA standards.

The present invention has been found to exceed the NFPA §1971 requirements for firefighters' bunker gear, with standing temperatures well above 500° F. and exhibiting heat shrinkages in the range of −2.4% to +8.5% (sample growth). The stretchable flame resistant fabric of the present invention further exhibits a stretchability of approximately 4 to 6% of its width after exposure to extreme temperatures in a forced air oven during testing and laundering. This stretchability is maintained under exposure of the fabric to temperatures well above 500° F. Further, even if stretchability of the fabric is decreased over time and exposure, the weave of the fabric is maintained so that the flame resistance protection provided by the fabric is not substantially diminished. The stretchable flame resistant fabric thus provides excellent protection to wearers against exposure to fire and temperatures of greater than 500° F., while still enabling enhanced flexibility, and thus freedom of movement, to garments formed therefrom.

Additionally, it will be understood by those skilled in the art that while the fabric of the present invention generally is formed with its filler yarns comprising stretchable core yarns wrapped with flame resistant fibers, it also is possible for the warp yarns to be formed from elastic core yarns wrapped with flame resistant fibers instead of or in addition to the filler yarns. As a result, the fabric can be made stretchable along its filling direction, along its warp direction, or in both directions to further enhance the flexibility of garments constructed therefrom.

Figure 3:
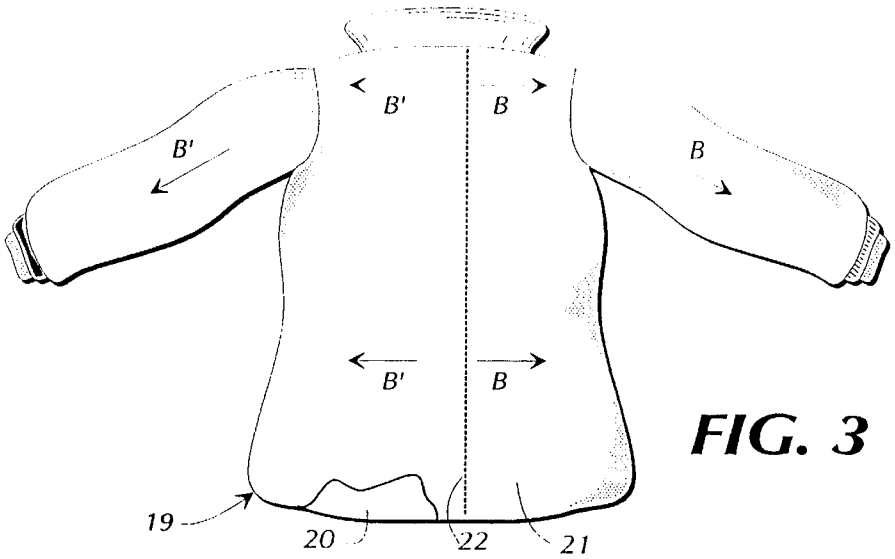
FIG. 3 is a back elevational view of a protective garment formed from the stretchable flame resistant fabric of the present invention.

The stretchable flame resistant fabric of the present invention is used to construct or form thermal/fire protective garments 19, such as a firefighters' turn-out coat, as indicated in FIG. 3. As FIG. 3 indicates, the garment typically includes an inner layer 20 of a thermal insulation material and an outer layer 21 formed from the stretchable flame resistant fabric of the present invention. However, it should be understood that the present invention can be used to form either layer of the garment and also can be used to form single layer garments and other types of garments. Generally, the garment 19 constructed from the fabric of the present invention is stretchable in the direction of arrows B and B', across the width of the body of the garment, across the spine of the wearer, and along the length of the sleeves of the garment, although it will be understood that such a garment also can be constructed so as to be stretchable along its length, along the spine of the wearer, and can be made stretchable in more than one direction to enable enhanced flexibility. The position of the wearer's spine is indicated by the dashed line 22.

This inherent stretchability of the fabric thus provides the fire protective garment with greatly enhanced flexibility, that enables the wearer a much greater degree of freedom of movement while wearing the garment. Such enhanced elasticity, flexibility and freedom of movement is achieved safely without risk of substantial loss of flame resistance protection of the garment. Even if the elastic core yarns of the fabric are melted or degraded by exposure to heat, the wrap yarns remain interwoven with the warp yarns such that the weave of the fabric is not broken and no gaps are formed in the fabric and thus no gaps are created in the flame resistance protection of the garment. Accordingly, it can be seen that the stretchable flame resistant fabric of the present invention advantageously enables flame protective garments to be formed that are safely more flexible and enable greater freedom of movement to a wearer without sacrificing thermal and/or flame resistant capabilities or protections of the garment.

While the present invention has been described in detail with respect to a preferred embodiment, it will be understood by those skilled in the art that numerous modifications, additions and deletions can be made thereto without departing from the spirit and scope of the invention as set forth in the following claims.

We claim:

1. A stretchable insulated fabric, comprising:

a plurality of warp fibers of a heat resistant material; and a plurality of filler fibers interwoven with said warp fibers, said filler fibers comprising core yarns of an elastic material of about 40 to 70 denier having wrap fibers of a heat resistant material wrapped thereabout to protect said core yarns from exposure to heat;

whereby the fabric is stretchable across at least one direction while also providing increased heat resistance protection.

2. The stretchable insulated fabric of claim 1, wherein said heat resistant material of said warp fibers and said wrap fibers is selected from the group consisting of: aramids, flame resistant polynosic rayon, flame resistant cotton, flame resistant polyester, polybenzimidazole, polyvinyl alcohol, polytetrafluoroethylene, flame resistant wool, poly(vinyl chloride), polyetheretherketone, polyetherimide, polyethersulfone, polychlal, polyimide, polyamide, polyimide-amide, polyolefin, polybenzoxazole, flame resistant acetone, carbon, modacrylic, acrylic, melamine and glass.

3. The stretchable insulated fabric of claim 1 and wherein said wrap fibers are a composite yarn of 8 to 11 cotton count and are tightly wound about said core yarns at about 9 to 11 turns per inch such that as said core yarns are stretched, said wrap fibers are straightened slightly so as to ensure that said wrap fibers substantially cover said core yarns to ensure said core yarns are substantially protected from exposure to heat as said core yarns are stretched.

4. The stretchable insulated fabric of claim 1 and wherein said warp fibers comprise core yarns of an elastic material wrapped with heat resistant fibers to protect said core yarns from exposure to heat while enabling said warp fibers to stretch along their length.

5. The insulated fabric of claim 1 and wherein said core yarns each are wrapped with multiple plies of wrap fibers.

6. A stretchable woven flame resistant fabric comprising:

warp yarns of flame resistant material, filler yarns interwoven with said warp yarns, said filler yarns comprising core spun yarns each having an elastic core yarn of about 40 to 70 denier and a flame resistant wrap yarn being wound sufficiently tightly about the core yarn to substantially shield the core yarn from radiant heat, such that as tension is applied to the filler yarns the fabric stretches in the direction of the length of the filler yarns and the wrap yarns continue to shield the core yarns.

7. A firefighter's turn out garment formed with the stretchable woven fabric of claim 6.

8. The stretchable flame resistant fabric of claim 6, and wherein said warp yarns are made of materials selected from the group consisting of: aramids, flame resistant polynosic rayon, flame resistant cotton, flame resistant polyester, polybenzimidazole, polyvinyl alcohol, polytetrafluoroethylene, flame resistant wool, poly(vinyl chloride), polyetheretherketone, polyetherimide, polyethersulfone, polychlal, polyimide, polyamide, polyimide-amide, polyolefin, polybenzoxazole, flame resistant acetone, carbon, modacrylic, acrylic, melamine and glass.

9. A stretchable flame resistant fabric comprising:

a series of warp yarns;

a series of flame resistant filler yarns interwoven with said warp yarns; and said warp yarns comprising core yarns of an elastic material of about 40 to 70 denier wrapped with fibers of a flame resistant material to protect said core yarns from exposure to heat to enable said warp yarns to be stretchable such that the fabric provides enhanced flame resistance protection and is stretchable across at least one direction.

10. The stretchable flame resistant fabric of claim 9 and wherein said filler yarns comprise core yarns of an elastic material having fibers of a flame resistant material wrapped thereabout to protect said core yarns from exposure to heat while enabling said filler yarns to stretch.

11. The stretchable insulated fabric of claim 1, wherein the fabric will not melt, drip, separate, or ignite upon static exposure in a 500° F. oven for at least 5 minutes and will not shrink more than 10% in the warp or filling direction upon such exposure.

12. The stretchable insulated fabric of claim 1, wherein the core yarn is about 6 to 14% by weight of the filler fiber.

13. The stretchable insulated fabric of claim 1, wherein said heat resistant material of said warp fibers and said wrap fibers is a blend of about 60% poly(p-phenyleneterephthalamide) and about 40% polybenzimidozde.

14. The stretchable insulated fabric of claim 1, further comprising a water repellant applied to said fabric.

15. A stretchable insulated fabric, comprising:

a plurality of warp fibers of a heat resistant material; and a plurality of filler fibers interwoven with said warp fibers, said filler fibers comprising core yarns of an elastic material of about 40 to 70 denier having wrap fibers of a heat resistant material wrapped thereabout to protect said core yarns from exposure to heat;

whereby the woven fabric has been subjected to a finishing application comprising heating the fabric to a temperature which causes the elastic core yarns to draw up and heating the fabric to relax the core yarns while the fabric is stretched to a desired width so that the fabric has a desired degree of elasticity; and whereby the fabric is stretchable across at least one direction while also providing increased heat resistance protection.

16. The stretchable insulated fabric of claim 15, whereby during the finishing application the fabric is jet scoured by applying a detergent in a water bath under pressure and at a temperature in excess of approximately 200° F. and thereafter a moisture repellant is applied to the fabric.

17. A flame resistant stretchable fabric created by a process comprising the steps:

preparing a filling yarn by twisting at least one ply of a flame resistant wrap fiber about core yarns formed from an elastic material sufficiently tight about the core yarns to substantially protect the core yarns from exposure to heat and flame;

weaving the filling yarns with a series of warp yarns of a flame resistant material;

subjecting the woven fabric to a finishing application to shrink the fabric and then relax the fabric to its desired elasticity.

18. The flame resistant stretchable fabric of claim 17 wherein the finishing application comprises the steps:

jet scouring the fabric by applying a detergent and water bath to the fabric under pressure and at a temperature in excess of approximately 200° F. so that the core yarns draw up and the fabric shrinks;

applying a finish to the fabric; and placing the shrunk fabric on a tenter frame to hold the fabric taut as the fabric is heated to relax the fabric and stretching the fabric until it achieves the desired elasticity.

19. The flame resistant stretchable fabric of claim 18 wherein the core yarns have a denier of from about 40 to 70.

20. The flame resistant and stretchable fabric of claim 18 wherein said heat resistant material of said warp fibers and said wrap fiber is selected from the group consisting of aramids, flame resistant polynosic rayon, flame resistant cotton, flame resistant polyester, polybenzimidazole, polyvinyl alcohol, polytetrafluoro ethylene, flame resistant wool, poly(vinyl chloride), polyetheretherketone, polyetherimide, polyethersulfone, polychlal, polyimide, polyamide, polyimide-amide, polyolefin, polybenzoxazole, flame resistant acetone, carbon, modacrylic, acrylic, melamine and glass.

21. The flame resistent stretched fabric of claim 18 wherein said finish is water repellant.

* * * * *